US005857748A

United States Patent [19]

Knight

[11] Patent Number: 5,857,748

[45] Date of Patent: Jan. 12, 1999

[54] SURF STAND

[75] Inventor: Kurtney G. Knight, St Rt Box 148 C, Poteet, Tex. 78065

[73] Assignee: Kurtney G. Knight, Poteet, Tex.

[21] Appl. No.: 954,208

[22] Filed: Oct. 20, 1997

[51] Int. Cl.[6] ..... A47C 9/10

[52] U.S. Cl. ..... 297/451.2; 297/217.1; 4/496; 182/115; 405/224; 405/195.1

[58] Field of Search ..... 297/217.1, 217.7, 297/451.2, 180.15; 4/496; 182/20, 33, 33.2, 21, 115; 405/224, 204, 195.1

[56] References Cited

U.S. PATENT DOCUMENTS

| | | | |
|---|---|---|---|
| 2,994,202 | 8/1961 | Knapp et al. | 405/224 |
| 3,220,766 | 11/1965 | Kates | 182/20 |
| 3,967,694 | 7/1976 | Woolfolk | 297/217.7 |
| 4,837,869 | 6/1989 | Simmon | 4/496 |
| 5,307,527 | 5/1994 | Schober | 4/496 |

*Primary Examiner*—Peter M. Cuomo
*Assistant Examiner*—Anthony D. Barfield

[57] ABSTRACT

A surf stand which can be used for surf fishing, life guard stands, and other marine functions. The lightweight stand can be easily manufactured and assembled from common, inexpensive materials. The surf stand features a unique construction which permits the application of suction forces within the legs to help set the stand firmly in the bottom soil or sand for stability and safety. The unique construction also permits pressurization of the legs to help dislodge them from the bottom when relocation or removal is desired.

6 Claims, 2 Drawing Sheets

SURF STAND

BACKGROUND OF THE INVENTION

1. Field of the Invention

The present invention relates generally to surf stands.

2. Background Information

This invention relates to a surf stand which can also be used for other marine functions. It is well known in the art that surf stands are subjected to wave action forces which diminish their stability in the water. These wave action forces vary widely and most surf stands are designed to be heavy and permanently attached to the bottom. Floating surf stands float freely but they must also be attached to a pier or piling that is firmly attached to the bottom.

The state of the art teaches heavy surf stands which resist wave action and remain stable because of their weight and because their piers go deep below the bottom surface. The surf stand taught by this invention is not disclosed or made obvious by prior art.

BRIEF SUMMARY OF THE INVENTION

It is an object of the present invention to provide a surf stand which can be used for surf fishing, life guard stands, or other marine functions. It is a further object of this invention to provide a portable, lightweight surf stand for various marine related functions.

For this purpose, this invention comprises a surf stand which is made of lightweight fabricated materials having parts which are assembled as shown in the drawings.

DETAILED DESCRIPTION OF THE INVENTION

Figure 1:
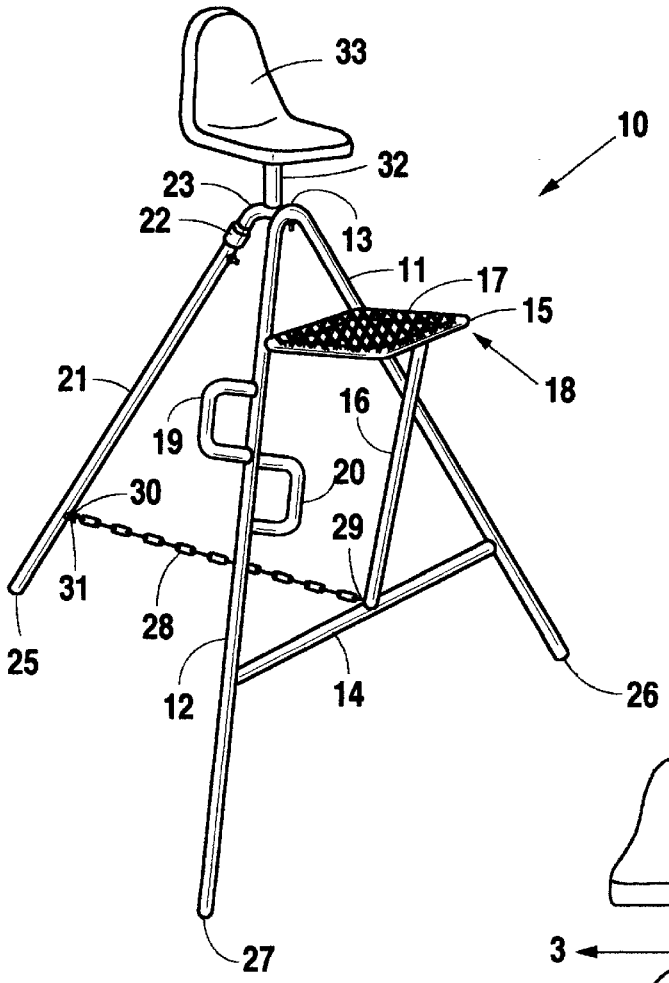
FIG. 1 is a perspective view of the assembled surf stand.
Figure 2:
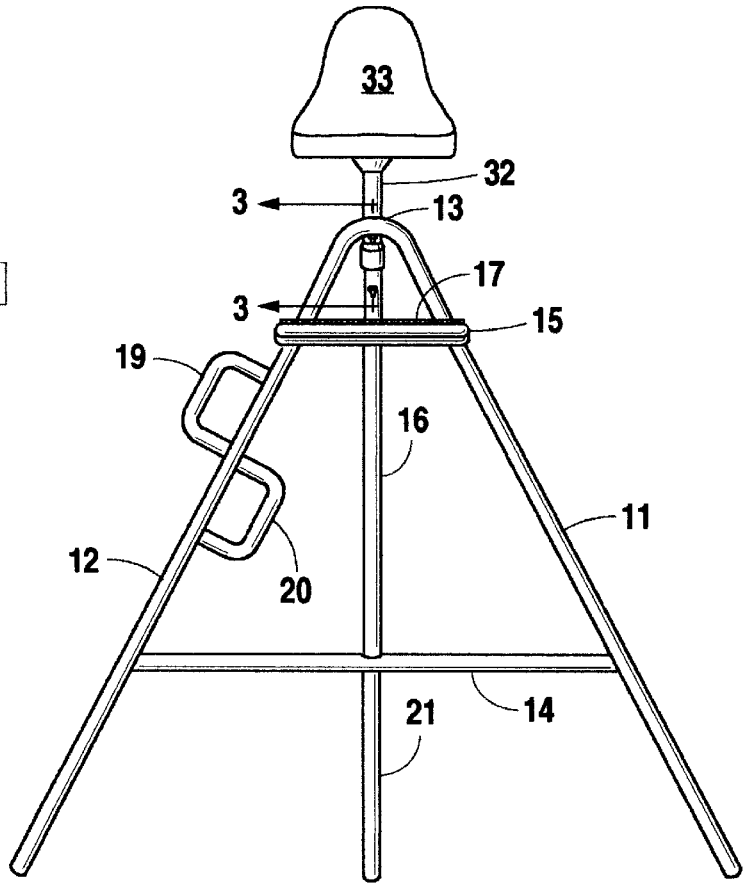
FIG. 2 is a front view of the assembled surf stand.
Figure 3:
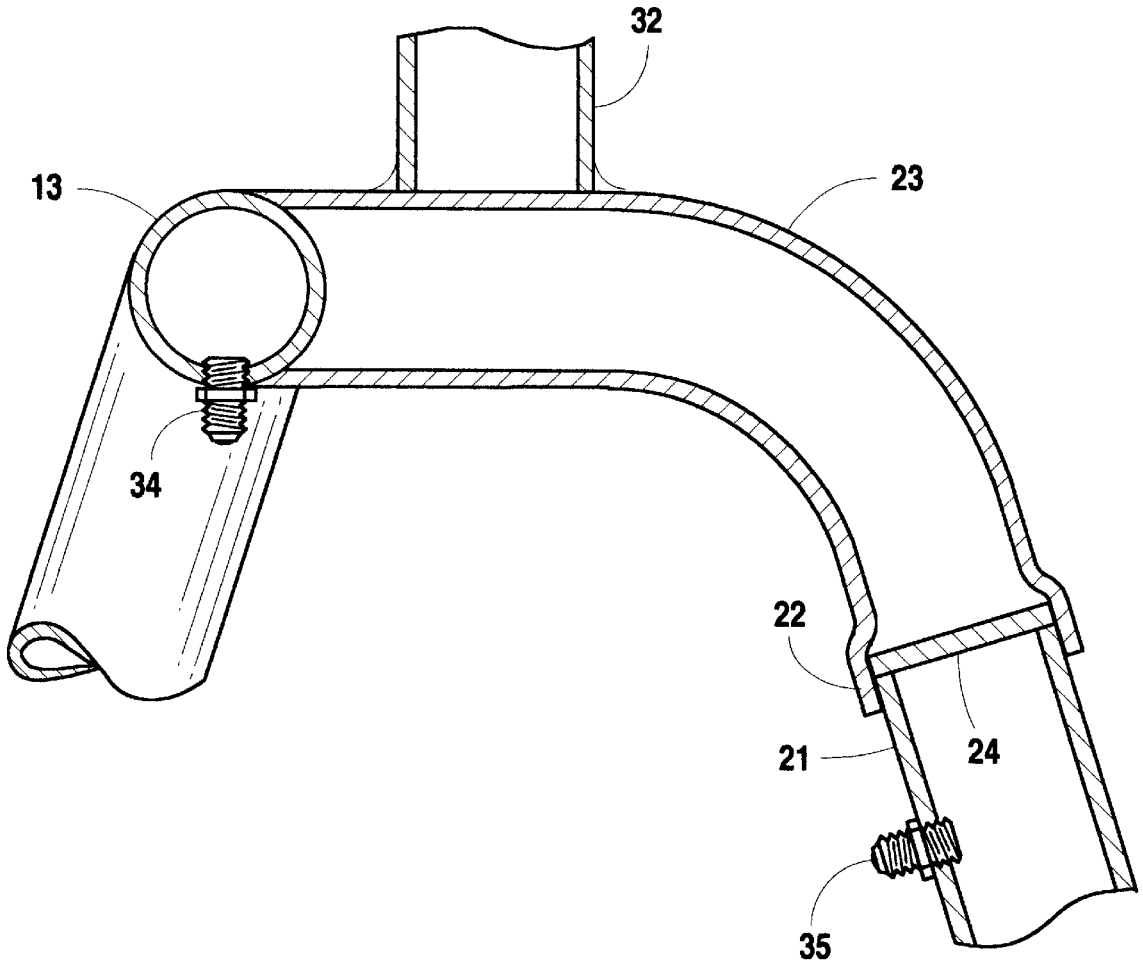
FIG. 3 is a cross-section which shows the area where the three legs come together below the seat.

Referring to FIG. 1, the surf stand(10) is shown with its component parts as they are to be assembled. Fixed leg(11) and fixed leg(12) are made from one continuous pipe by bend(13). Fixed leg support member(14) is attached to fixed leg(11) and fixed leg(12) by welds, brackets, or other suitable means without breaking or penetrating the surface of fixed leg(11) or fixed leg(12). Platform frame(15) is attached to fixed leg(11) and fixed leg(12) by welds, brackets, or other suitable means without breaking or penetrating the surface of fixed leg(11) or fixed leg(12). Support brace(16) is attached to platform frame(15) and fixed leg support member(14) by a weld, bracket, or other suitable means. Grate(17) is attached to platform frame(15) by welds, brackets, or other suitable means to support weight on platform(18). Step(19) and step(20) are attached to fixed leg(12) by welds or brackets without breaking or penetrating the surface of fixed leg(12). Step(19) and step(20) are mounted in positions on fixed leg(12) that will permit safe climbing onto platform(18). Removable leg(21) is made from one straight pipe which is connected to fixed leg(11) and fixed leg(12) by flange(22) and connecting pipe(23). Connecting pipe(23) is welded at the bend(13) where fixed leg(11) and fixed leg(12) come together without breaking or penetrating the surface of fixed leg(11) or fixed leg(12). Removable leg(21) is sealed by cap(24) which is welded to the top end of removable leg(21) and is inserted into flange(22). The bottom ends (25), (26), and (27) of removable leg(21), fixed leg(11), and fixed leg(12) are all open where removable leg(21), fixed leg(11), and fixed leg(12) contact and penetrate the sand or soil surface below the water. Flexible tension member(28) is connected to the midpoint of fixed leg support member(14) by C-shaped connection(29). C-shaped connection(29) is welded to the inner midpoint of fixed leg support member(14) which faces removable leg(21). Flexible tension member(28) is connected to removable leg(21) by a removable hook fastener (30) which connects C-shaped connection(31). C-shaped connection(31) is welded to removable leg(21) without breaking or penetrating the surface of removable leg(21). Seat support(32) is welded to connecting pipe(23) and supports swivel seat(33). Air suction and pressure valve(34) is installed at the bottom interior side of bend(13) which connects fixed leg(11) and fixed leg(12). Air suction and pressure valve(35) is installed in removable leg(21) near cap(24). Air suction and pressure valve(34) and air suction and pressure valve(35) are both used in conjunction with a pump that can apply both suction and pressure to fixed leg(11), fixed leg(12), and removable leg(21) when they are submerged into the sand or soil surface below the water. Suction is applied to fixed leg(11), fixed leg(12), and removable leg(21) through air suction and pressure valves(34) and (35) to help force fixed leg(11), fixed leg(12), and removable leg(21) into the sand or soil until an equilibrium position is reached. This equilibrium depth or position will be reached when the total weight of the stand and load together with the suction force are balanced by the upward force of the bottom sand or soil on the lower submerged surfaces of fixed leg(11), fixed leg(12), and removable leg(21). Once the desired equilibrium position or depth is reached, air suction and pressure valve(34) and air suction and pressure valve (35) are opened to the atmosphere to maintain the desired position or depth as the water level rises and falls. If this suction is held on fixed leg(11), fixed leg(12), and removable leg(21) under certain sand and soil conditions, the stand will continue to go deeper because the rising and falling wave action will continue to produce pressure and suction forces within fixed leg(11), fixed leg(12), and removable leg(21) as the waves rise and fall. Under these conditions, these forces will continue to disrupt the natural equilibrium that would be reached if the suction forces were removed from fixed leg(11), fixed leg(12), and removable leg(21). Air suction and pressure valve(34) and air suction and pressure valve (35) can also be used to apply pressure to fixed leg(11), fixed leg(12), and removable leg(21) when removal of the stand from the sand or soil is desired. Another benefit for applying pressure is to remove sand or soil that will tend to plug up fixed leg(11) , fixed leg(12), and removable leg(21) when they are removed from the sand or soil.

I claim:

1. A surf stand, comprising:

a tripod means which provides stable support for the surf stand when it is installed in the water;

an access means which allows a person to climb safely onto the surf stand when it is installed in the water;

a platform means which provides a structure for a person to safely climb onto and stand when the surf stand is installed in the water;

a seating means which provides a seat for a person to be seated safely when the surf stand is installed in the water;

a valve means that can be connected to a pump for selective application of a suction or pressure force inside the surf stand when the surf stand is installed in the water.

2. The apparatus of claim 1 wherein said tripod means comprises a three leg structure with one removable leg, two fixed legs, and a flexible tension member connecting said removable leg to the midpoint of a fixed leg support member and said flexible tension member is connected to said removable leg when said removable leg is installed into said tripod.

3. The apparatus of claim 2 wherein said access means comprises two steps which are attached to one of said fixed legs by one from the group consisting of welded or bracketed connections.

4. The apparatus of claim 2 wherein said platform means comprises a platform frame that is attached to said fixed legs and a platform brace by one from the group consisting of welded or bracketed connections.

5. The apparatus of claim 2 wherein said seating means comprises a swivel seat which is connected to a seat support which is welded to said three leg structure.

6. The apparatus of claim 1 wherein said valve means comprises a valve with a threaded fitting which can be in the open or closed position so it can be connected to a pump hose by the threaded fitting.

* * * * *